US006228448B1

(12) United States Patent
Ndebi et al.

(10) Patent No.: US 6,228,448 B1
(45) Date of Patent: May 8, 2001

(54) ENDLESS BELT FOR USE IN DIGITAL IMAGING SYSTEMS

(75) Inventors: Sylvain L. Ndebi, Asheville; William Haul Haddock, Candler; Allen T. Shannon; Michael E. McLean, both of Waynesville; Melvin Douglas Pinkston, Hendersonville; Ray Brooks; Thomas Gerald Ferguson, both of Waynesville, all of NC (US)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 09/256,532

(22) Filed: Feb. 24, 1999

(51) Int. Cl.[7] ..... G03G 15/16

(52) U.S. Cl. ..... 428/36.91; 428/36.1; 428/36.2; 428/35.2; 355/275; 442/97; 442/101; 442/110; 442/131; 474/268

(58) Field of Search ..... 355/275; 428/36.1, 428/36.2, 35.2, 36.91; 474/268; 442/97, 101, 110, 131

(56) References Cited

U.S. PATENT DOCUMENTS

| | | |
|---|---|---|
| 1,804,139 | 5/1931 | Adsit et al. . |
| 4,009,957 | 3/1977 | Suzuki et al. . |
| 4,788,572 | 11/1988 | Slayton et al. . |
| 5,079,121 | 1/1992 | Facci et al. . |
| 5,128,091 | 7/1992 | Agur et al. . |
| 5,258,154 | 11/1993 | Okuyama et al. . |
| 5,298,956 | 3/1994 | Mammino et al. . |
| 5,308,725 | 5/1994 | Yu et al. . |
| 5,413,810 | 5/1995 | Mastalski . |
| 5,899,610 | 5/1999 | Enomoto et al. . |

FOREIGN PATENT DOCUMENTS

| | | |
|---|---|---|
| 0 784 244 | 7/1997 | (EP) . |
| 9-305038 | 11/1997 | (JP) . |
| 10-232572 | 9/1998 | (JP) . |

*Primary Examiner*—Terrel Morris
*Assistant Examiner*—Arti R. Singh
(74) *Attorney, Agent, or Firm*—Killworth, Gottman, Hagan & Schaeff, L.L.P.

(57) ABSTRACT

An endless belt for use in digital imaging systems is provided having edge to edge uniform flatness, and precise circumferential and edge to edge thickness. The layers comprising the belt may be tailored as desired for use in either image recording, image transfer or sheet transport operations. In one embodiment, the belt includes an elastomeric base layer, an elastomer-impregnated spun cord layer, a woven or non-woven fabric layer, and an elastomeric surface ply. The belt is preferably manufactured by building the layers on a workpiece and then curing the layers.

11 Claims, 2 Drawing Sheets

ENDLESS BELT FOR USE IN DIGITAL IMAGING SYSTEMS

BACKGROUND OF THE INVENTION

The present invention is directed to an endless belt and method of making it for use in digital imaging systems, and more particularly, to such a seamless, reinforced belt which may be used in intermediate image transfer, toner fusing or transfusing, and/or sheet transport operations.

Digital imaging systems are widely used in the field of xerography and electrography where dry or liquid toner is used to print text and graphic images. For example, systems which use digitally addressable writing heads to form latent images include laser, light-emitting diode, and electron beam printers. Copiers use optical means to form latent images. Regardless of how they are formed, the latent images are inked (or toned), transferred and fixed to a paper or polymer substrate. Such systems typically include a component such as an endless belt, roll or drum which is utilized for latent image recording, intermediate image transfer (transfer of a toner image to the belt followed by transfer to a substrate), transfusing of toner (transport of the unfused image onto the belt with subsequent fusing), contact fusing, or electrostatic and/or frictional transport of imaging substrates such as paper, transparencies, etc.

In the case of endless belts, such belts are typically moved or driven under appropriate traction and tension by rotating cylindrical rollers. As such belts play a critical role in the imaging or substrate transport process, they must be engineered to meet exacting standards. For example, image transfer belts must be seamless, flexible, and must exhibit uniform flatness. Further, the belts should provide certain electrical properties (dielectric constant, volume and surface resistivity, etc.) chemical properties (resistance to humidity, UV light, etc.) and dimensional specifications (circumference, thickness, width, etc.) which may vary depending on the desired application.

If the belts include nonuniformities as manufactured or in operation, various problems arise. For example, where the belts are used for latent image recording, surface flatness is of critical importance as the surface of the belt may be electrostatically charged using high resolution laser beams positioned over the belt. If the belt is not uniformly flat, image quality may suffer due to randomly localized deformation.

Accordingly, there is still a need in the art for an endless belt for use in digital imaging systems which can be manufactured and operated to be within exacting tolerances, including surface flatness, and which may be used for a wide variety of imaging, image transfer or sheet transport operations.

SUMMARY OF THE INVENTION

The present invention meets that need by providing an endless belt having precise and uniform flatness which also possesses a working surface which can be tailored to provide the proper characteristics for image transfer or sheet transport.

In accordance with one aspect of the present invention, an endless belt for use in a digital imaging system is provided which has first and second edges and a plurality of plies. By uniform flatness, it is meant that the thickness of the belt varies less than 0.001 inches (0.003 cm) from the first edge to the second edge and also from one circumferential point (location) to another. The circumferential uniformity of the belt also varies less than 0.005 inches (0.013 cm) circumferentially in conicity to provide circumferential uniformity over the entire belt structure.

The belt includes an elastomeric base ply and an elastomer-impregnated spun cord layer on the base ply. By "cord", we mean either a single fiber or multiple fibers formed into a continuous cord. By "impregnated", we mean that the elastomer at least partially occupies spaces between the spun fiber or fibers but does not necessarily impregnate individual fibers.

The belt further comprises a woven or non-woven fabric ply on the cord layer, and an outer elastomeric ply on the fabric ply which has a working surface. The fabric ply may also be impregnated with an elastomer. It should be understood that for purposes of the present invention, the term "on" when referring to the position of the plies means that one ply is adjacent to and in contact with the ply that it is "on". Further, it should be understood that for purposes of the present invention, the terms "ply" and "layer" are interchangeable.

The outer elastomeric ply functions as a working surface layer which is adapted to accept an imaging composition or to transport a substrate. For example, the surface layer may be used as an intermediate image transfer surface which accepts a toned and unfused image from an image recording component; as a dielectric surface which accepts electrostatic surface charge density for attracting, holding in register, and transporting paper or transparency substrates; or as a toner fusing surface which can press and fix (or fuse) toner to a substrate.

The elastomeric base ply and outer ply are preferably selected from the group consisting of silicone, fluorosilicone, fluorocarbon, EPDM (ethylene-propylene diene terpolymers), EPM (ethylene-propylene copolymers), polyurethane elastomers, and blends thereof. The elastomer used to impregnate the spun-cord and fabric layers may also comprise the above elastomers.

In one embodiment of the invention, the outer elastomeric ply is electrically conductive. By electrically conductive, it is meant that the outer elastomeric ply preferably has a surface resistivity of less than about $10^{14}$ ohm/square which is desirable for intermediate image transfer, toner fusing or transfusing applications.

In applications such as substrate transport in which a surface charge density is applied to the working surface layer, the outer elastomeric ply or entire endless belt preferably has a volume resistivity of greater than about $10^{12}$ ohm •cm.

The method of making the endless belt generally comprises the steps of applying an uncured elastomer to a workpiece such as a mandrel to form a base layer. The elastomer is preferably coated onto the surface of the workpiece in the form of a solvated rubber or cement. Next, the workpiece is rotated to wind an elastomer-impregnated cord circumferentially around the base layer, and a woven or non-woven fabric layer is applied over the cord layer. Preferably, the wound cord layer is coated with additional elastomer prior to application of the fabric layer. An uncured elastomer layer is then applied over the fabric layer to form an outer layer. The outer elastomer layer may be applied by coating it in the form of a solvated rubber or it may be applied in the form of a calendered formable sheet.

After the outer elastomeric layer is applied, the assembled layers are then cured. After curing, the surface of the outer elastomeric layer is preferably ground or otherwise treated to achieve uniform flatness such that the elastomeric layer functions as a working surface layer as described above.

Endless belts formed by the methods of the present invention have been found to exhibit excellent performance when installed under tension in digital imaging machines. Based on the construction and choice of elastomer, the belts have also been found to exhibit adequate toner acceptance properties for use in intermediate image transfer, adequate retention of surface charge density for substrate transport applications, or good toner release properties for fusing or transfusing applications.

Accordingly, it is a feature of the present invention to provide a seamless belt for use in digital imaging machines which exhibits uniform flatness, and which can be used for latent image recording, intermediate image transfer, substrate transport, toner fusing or toner transfusing. These, and other features and advantages of the present invention will become apparent from the following detailed description, the accompanying drawings, and the appended claims.

DETAILED DESCRIPTION OF THE PREFERRED EMBODIMENT

The seamless belt of the present invention provides an advantage over prior art belts in that it may be manufactured within exacting tolerances to obtain flatness uniformity and superior performance under rotational tension. In addition, the plies may be varied and, if necessary, interchanged for specific applications such that the belt can be tailored for use in latent image recording, intermediate image transfer, substrate transport, and toner fusing or toner transfusing.

For example, in substrate transport applications in which a surface charge density is applied over the outer layer, the outer elastomeric ply or the entire endless belt has a back to face bulk resistivity of about $10^{12}$ ohm •cm or higher. For intermediate image transfer, the outer layer preferably comprises an elastomer such as, for example, silicone, fluorocarbon, or fluorosilicone, that is capable of releasing toner and has a surface resistivity of less than about $10^{14}$ ohm/square. For toner fusing, all of the layers in the belt are comprised of high temperature resistant and thermal transfer efficient elastomers such as silicone or fluorocarbon. For transfusing applications, the outer layer is preferably comprised of a high temperature resistant elastomer that has adequate toner release properties and a surface resistivity of less than about $10^{14}$ ohm/square.

Figure 1:
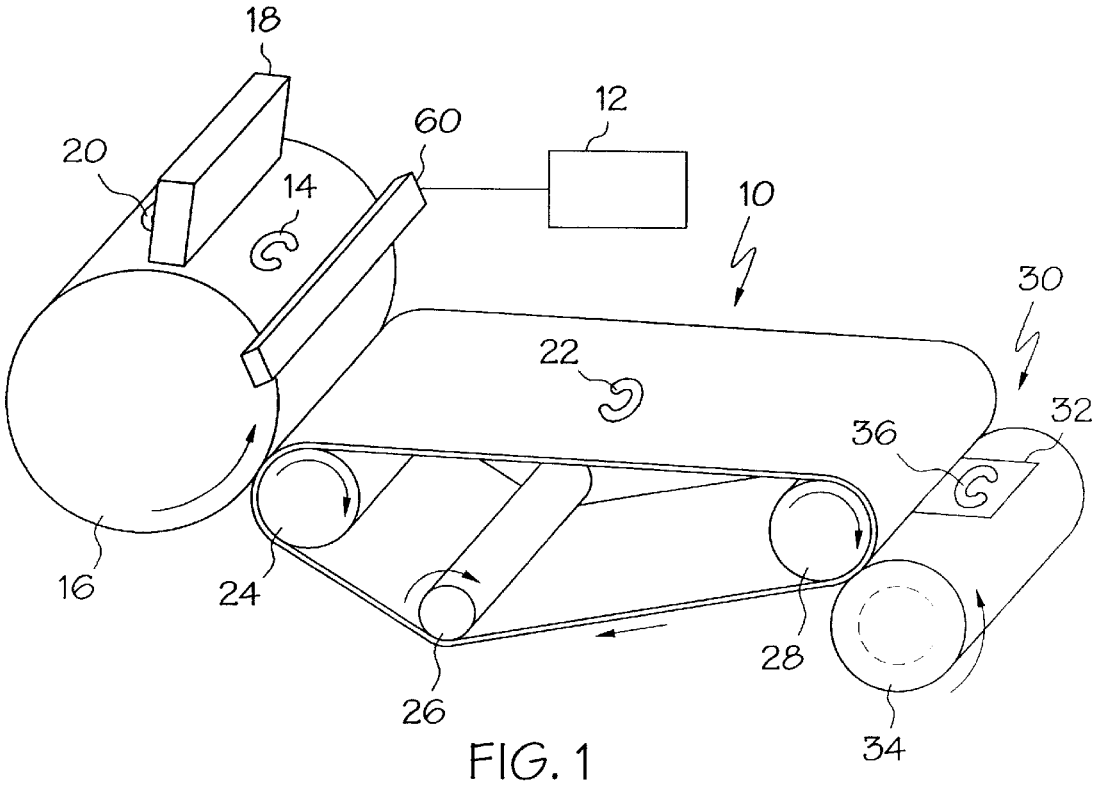
FIG. 1 is a perspective view of the belt of the present invention mounted on rotational rollers.
Figure 2:
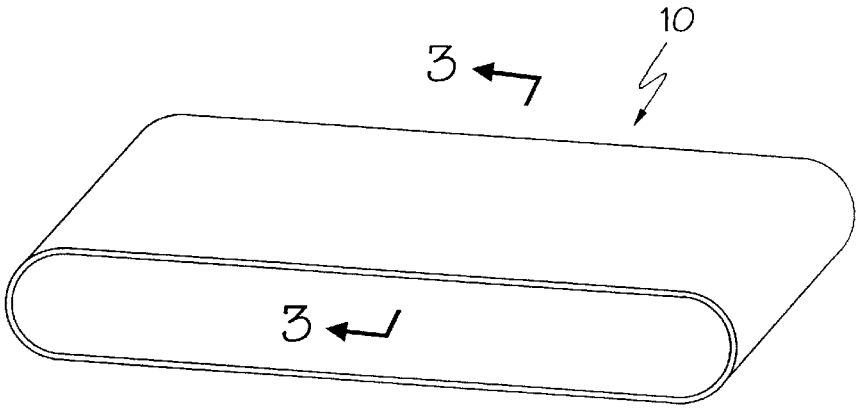
FIG. 2 is a perspective view of the belt of FIG. 1.

Referring now to FIGS. 1 and 2, a belt 10 made according to the present invention is illustrated which has a seamless, uniformly flat structure. In the embodiment shown in FIG. 1, the belt 10 is used for intermediate image transfer. In other applications, the belt may be used on a recording drum such as the recording drum 16 shown in FIG. 1. Initially, a computer 12 controls the formation of a latent image 14 via a writing head 60 (such as a laser or LED, for example) onto a recording drum 16. The latent image electrostatically attracts dry toner from a toner cartridge 18 to form a toned, unfused image 20. This image is then transferred to the belt 10 in the form of an intermediate image 22. The belt is driven by rollers 24, 26 and 28 which advance the intermediate image through a transfusing nip 30 where heat and pressure are applied to simultaneously transfer and fuse the toner image onto a substrate 32 which is synchronously and frictionally advanced by fusing roller 34 and belt 10 to form the final, fused image 36. It should be appreciated that latent image 14, unfused image 20, intermediate image 22 and fused image 36 are shown in such a way as to better illustrate the sequence of steps involved in forming an image. For example, in the actual process, transfer and fusing of image 36 onto substrate 32 actually occurs at nip 30.

The above-described process can also be adapted for use with liquid toner.

Figure 3:
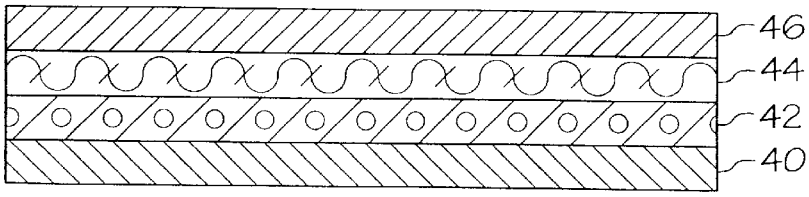
FIG. 3 is a sectional view taken along lines 3—3 of FIG. 2.

FIG. 3 illustrates the endless belt made according to one embodiment of the present invention. The belt 10 includes an elastomeric base ply 40, an elastomer-impregnated spun cord layer 42 on the base ply, a woven or non-woven fabric layer 44 on the cord layer, and an outer elastomeric layer 46.

The elastomeric base ply 40 and outer elastomeric layer 46 may be comprised of silicone, fluorosilicone, fluorocarbon, EPDK, EPM, or urethane.

The elastomeric-impregnated spun cord layer 42 provides circumferential uniformity and strength to the belt. The spun cord layer may be selected from fabric, plastic, or metal cord or fiber such as polyaramid, fiberglass or stainless steel, for example, which has been dipped in a solution of an elastomer in a solvent, and wrapped or spun around a mandrel as will be explained in greater detail below.

The fabric ply 44 provides transverse strength to the belt and may comprise high temperature resistant aramid fibers, for example. The fabric ply is preferably impregnated with any of the above elastomers as will be described below.

Preferably, the elastomeric surface ply is comprised of a silicone rubber such as polydimethyl siloxane or methylvinyl siloxane based rubber mixed with other ingredients according to the desired specifications. The elastomeric surface ply may be electrically conductive or non-conductive, depending on the desired application of the belt. Where a conductive elastomeric ply is desirable, the elastomer is preferably doped with a sufficient amount of carbon black or other conductive additives to give the outer ply or entire endless belt a surface resistivity of less than about $10^{14}$ ohm/square.

Figure 4:
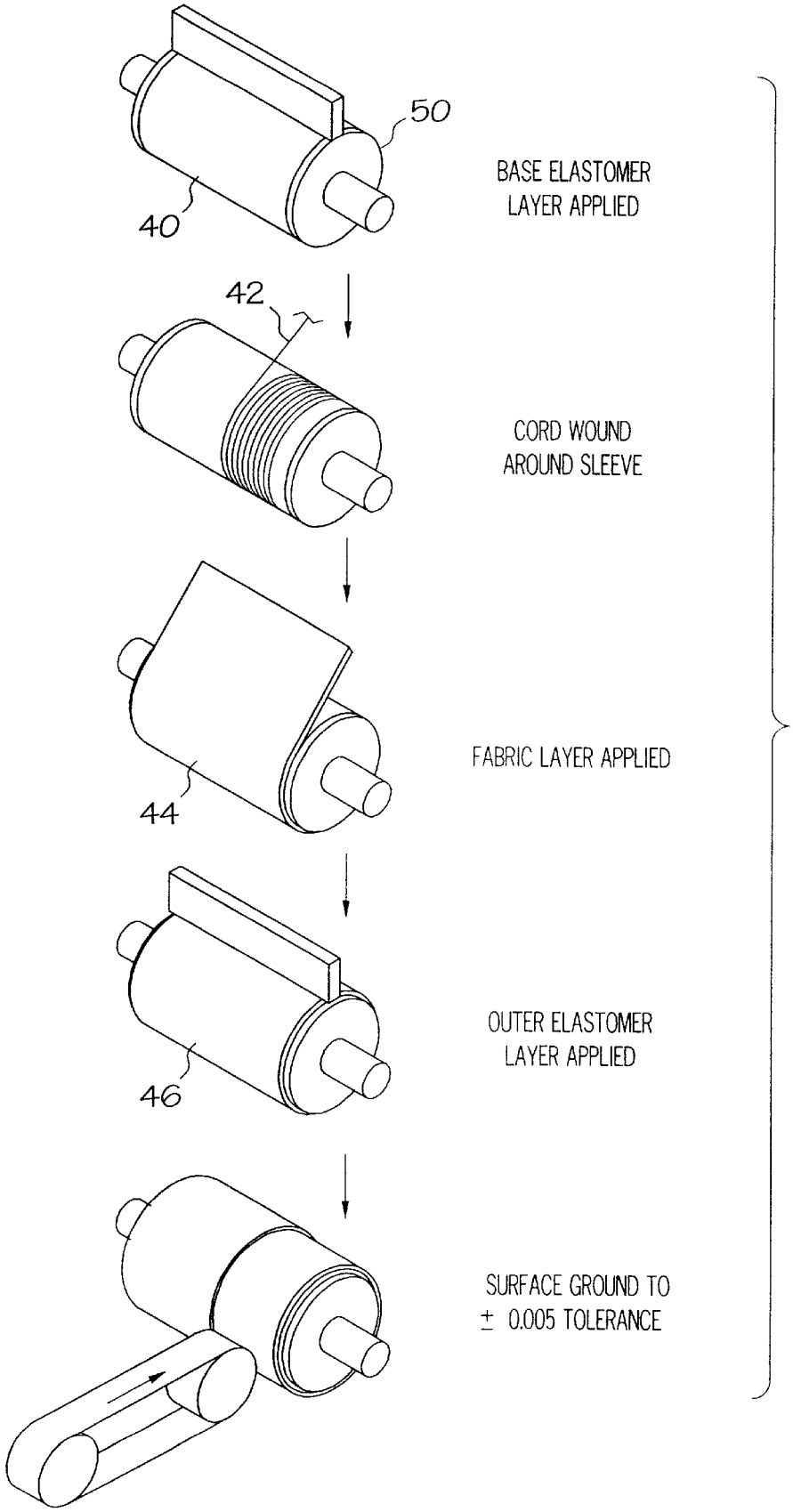
FIG. 4 is a flow diagram illustrating the steps of one method of making the belt of the present invention.

Reference is now made to FIG. 4 which is a flow diagram illustrating the steps in one method of preparing the seamless belt of the present invention. Like reference numbers in FIG. 4 represent the same elements as described in FIG. 3.

In order to achieve precise edge to edge circumferential uniformity, a fixed and highly toleranced workpiece such as a metallic cylinder or cylindrical mandrel 50 with a polished surface is used to build the belt. An elastomer provided in a solvent solution is then applied to the mandrel, either by knife coating or roller coating to form base elastomer layer 40.

Next, fabric, plastic, or metal cord 42 is dipped into a dipping tank (not shown) containing a solvated elastomer having a controlled viscosity. Preferably, the cord comprises heat resistant aramid fiber(s), but may also comprise nylon, cotton, wool or other materials, depending on the desired end use for the belt. The cylindrical mandrel 50 is then rotated such that the dipped cord is spin-wound circumferentially left to right in the desired cord tension and cord spacing pattern. Singular or overlapping cord patterns may be used. After the rubber dipped cord has been spin-wound, a thin layer of rubber cement is preferably knife-coated over the circumferentially wound cord to fill the spaces between the cord.

Next, a non-woven or loosely woven fabric 44 of very thin caliper is layered over the surface of the cord layer. Preferably, the fabric is dipped in a solvated rubber cement prior to application over the cord layer.

Finally, a solvated elastomer is knife-coated to the desired thickness over the fabric layer to form the elastomeric surface layer 46. Alternatively, the surface layer may be built by using calendered and formable sheets of rubber that are directly applied to the fabric layer.

After the belt is built over the cylindrical mandrel, it is tightly wrapped in a plastic jacket (not shown) and placed under heat and pressure to cure the elastomer rubber in the layers of the belt. Upon curing, the belt is unwrapped at room temperature and finished according to desired specifications such as Ra, matte or glossy, etc. in order to form a useful working surface. The working surface is preferably ground to a +/−0.0005 inch (0.0013 cm) thickness tolerance.

In applications in which a cast surface is desired, the belt layers may be formed in reverse order from the method illustrated in FIG. 4, e.g., the elastomer layer 46 is applied first over the metallic cylinder or cylindrical mandrel 50. Next, fabric layer 44 is applied over layer 46 in the manner described above. Spun cord layer 42 is then wound over layer 46 as described above and elastomer layer 40 is applied over cord layer 42. The assembly is tightly wrapped and cured. Upon curing, elastomer layer 40 is ground to a desired gauge. Finally, the belt structure is inverted such that the cast layer 46 forms the outer working surface layer and the ground layer 40 becomes the base layer.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An endless belt for use in a digital imaging system having first and second edges and a plurality of plies comprising:

an elastomeric base ply, an elastomer-impregnated cord layer on said base ply, a woven or non-woven fabric ply on said cord layer, and an outer elastomeric ply having a working surface on said fabric ply.

2. An endless belt as claimed in claim 1 in which said working surface of said outer ply is adapted to accept an image composition.

3. An endless belt as claimed in claim 1 in which said working surface of said outer ply is adapted to transport a substrate.

4. An endless belt as claimed in claim 1 in which said working surface of said outer ply is adapted to hold an intermediate unfused toner image.

5. An endless belt as claimed in claim 4 in which said belt is adapted to transfer and fuse said unfused toner image onto a substrate.

6. An endless belt as claimed in claim 1 wherein the thickness of said belt varies less than 0.001 inches (0.003 cm) from said first edge to said second edge and also from one circumferential point (location) to another.

7. An endless belt as claimed in claim 1 wherein the circumferential uniformity of said belt varies less than 0.005 inches (0.013 cm) in conicity.

8. An endless belt as claimed in claim 1 in which said elastomeric plies are selected from the group consisting of silicone, fluorosilicone, fluorocarbon, EPDM, EPM, polyurethane elastomers, and blends thereof.

9. An endless belt as claimed in claim 1 in which said woven or non-woven fabric ply is impregnated with an elastomer selected from the group consisting of silicone, fluorosilicone, fluorocarbon, EPDM, EPM, polyurethane elastomers, and blends thereof.

10. An endless belt as claimed in claim 1 in which said outer elastomeric ply is electrically conductive or electrically insulative.

11. An endless belt as claimed in claim 1 in which said belt or said outer elastomeric ply has a volume resistivity of greater than about $10^{12}$ ohm •cm.

* * * * *